US006880714B2

(12) United States Patent
Blanchester

(10) Patent No.: US 6,880,714 B2
(45) Date of Patent: Apr. 19, 2005

(54) CARRYING DEVICE FOR A BOTTLE

(76) Inventor: Tom Blanchester, Suite 248, 1348 Washington Ave., Miami Beach, FL (US) 33139

( * ) Notice: Subject to any disclaimer, the term of this patent is extended or adjusted under 35 U.S.C. 154(b) by 0 days.

(21) Appl. No.: 10/628,520

(22) Filed: Jul. 27, 2003

(65) Prior Publication Data

US 2004/0050815 A1 Mar. 18, 2004

Related U.S. Application Data

(63) Continuation-in-part of application No. 29/177,805, filed on Mar. 16, 2003.

(30) Foreign Application Priority Data

Sep. 18, 2002 (SE) ..... 02-1364
Sep. 18, 2002 (SE) ..... 0202768

(51) Int. Cl.[7] ..... B65D 23/12; B65D 25/10

(52) U.S. Cl. ..... 215/399; 215/395; 220/751; 224/148.4

(58) Field of Search ..... 215/395, 399; 220/751; 294/27.1, 31.2; 224/148.4

(56) References Cited

U.S. PATENT DOCUMENTS

| | | | | | |
|---|---|---|---|---|---|
| 2,227,780 | A | * | 1/1941 | Hickman et al. | 294/27.1 |
| 2,248,234 | A | * | 7/1941 | Hickman et al. | 294/27.1 |
| 2,362,523 | A | * | 11/1944 | Armstrong, Jr. et al. | 215/399 |
| 3,299,442 | A | * | 1/1967 | White et al. | 604/322 |
| 3,463,536 | A | * | 8/1969 | Beyer et al. | 294/31.2 |
| 4,627,546 | A | * | 12/1986 | Carranza | 215/396 |
| 4,724,971 | A | * | 2/1988 | Henline | 215/396 |
| 5,301,857 | A | | 4/1994 | Green | |
| D364,552 | S | * | 11/1995 | Mathiassen | D8/367 |
| 5,573,152 | A | * | 11/1996 | Arnold | 224/148.4 |
| 5,749,490 | A | * | 5/1998 | Keicher | 220/481 |
| 5,749,497 | A | | 5/1998 | Davis | |
| 6,131,779 | A | * | 10/2000 | Gendala | 224/148.1 |

FOREIGN PATENT DOCUMENTS

| | | | | |
|---|---|---|---|---|
| DE | 200 02 844 U 1 | | 9/2000 | |
| GB | G 83 24 474.3 | | 2/1985 | |
| GB | 2225527 A | * | 6/1990 | A45F/5/10 |
| JP | 2000302133 | | 10/2000 | |
| JP | 2001286324 A | * | 10/2001 | A45C/13/30 |
| NO | 944185 | | 4/1997 | |

* cited by examiner

*Primary Examiner*—Sue A. Weaver
(74) *Attorney, Agent, or Firm*—Yi Li

(57) ABSTRACT

A carrying device for attaching to a bottle around a bottle neck is disclosed. The carrying device has a ring segment that is received by the neck below the bottle cap and a hook segment attached to the ring segment. The ring segment is shaped as a substantially thin planar disc, and the hook segment is planar and thin. The hook segment and the ring segment extend in a common plane and are foldable along an axis line between the hook segment and the ring segment. The axis line is perpendicularly to a connection line between centers of the openings of the hook segment and the ring segment. The planar ring segment and hook segment can be folded toward each other and be secured around bottle neck by a cap. In use, the carrying device is unfolded and having the hook segment available for attachment.

15 Claims, 4 Drawing Sheets

CARRYING DEVICE FOR A BOTTLE

CROSS REFERENCE TO RELATED APPLICATION

This application claims priority of Swedish patent application No. 0202768-8 filed Sep. 18, 2002, and is a continuation -in-part of U.S. design patent application No. 29/177,805 filed Mar. 16, 2003 which claims the priority of Swedish design application No. 02-1364 filed Sep. 18, 2002, U.S. design patent application No. 29/177,805 is herein incorporated by reference in its entirety.

FIELD OF THE INVENTION

The invention relates to a carrying device for a bottle, particularly to a foldable carrying device having a hook segment.

BACKGROUND OF THE INVENTION

The carrying device is adapted to be applied around a bottle neck, below a surrounding cap of the bottle neck. U.S. Pat. No. 5,301,857 shows a known carrying device that has a first ring segment that may be received by the neck below the cap and a hook segment that is attached to the ring segment to enable the ring segment, and thus the bottle, to be hung on a support such as a finger.

The known carrying device has a ring segment that is shaped as a conical shell that has radially inwardly directed tongues disposed along the edge of the opening so that the ring segment can be placed over the lid of bottle neck. The tongues are spring biased to grip a lower edge of the cap. The hook segment has an opening that is substantially smaller than the ring element.

The carrying device of the present invention is preferably made from a thin sheet shaped or disc shaped material. It is often desirable to reduce the thickness of the material as much as is practically possible with regard to the required stiffness and durability. When the carrying device is form sprayed it can be provided with stiffening ribs in a conventional way.

SUMMARY OF THE INVENTION

One object of the present invention is to provide a carrying device where both the hook segment and the ring segment are thin planar and can be situated in the same plane.

Another object of the present invention is to provide a carrying device where the ring segment and the hook segment have substantially the same size of openings so that either the ring segment or the hook element can be applied about the bottle neck.

Yet another object of the present invention is to provide a carrying device which can be folded along a folding line between the hook segment and the ring segment and can be secured around a bottle neck underneath the bottle cap.

A further object of the present invention is to form the opening of the ring segment so that it can be used on bottle necks that have somewhat different sizes.

A yet further object of the present invention is provide a carrying device wherein the ring segment can be inserted downward around a bottle cap which is secured to a bottle neck, to underneath the bottle cap.

Additional object of the present invention is to provide an assembling of a bottle attached with a removable carrying device.

DETAILED DESCRIPTION OF THE INVENTION

Because the openings of the ring segment and the hook segment have substantially the same size, either the ring segment or the hook segment can be applied around the bottle neck and either the ring segment or the hook segment may be used to hang the carrying device. By forming the carrying device from a plane sheet-shaped material and by providing the carrying device with a folding line, that is disposed between the centers of the hook element and the ring segment and extends perpendicularly to a connection line between these centers, the ring element may be aligned over the hook element and be directed towards the hook element. The folded carrying device can thus be applied on the bottle neck when the cap is removed and be secured by applying the cap. The folded carrying device provides a good finger support for, for example, the index finger and the middle finger of the hand that is carrying the bottle.

Because the opening of the ring segment has radially inwardly extending tongues between cavities defined therebetween, the edges of the tongues can be tightly sealed against the bottle neck or threaded section of the bottle neck that has a corresponding outer diameter.

When the bottle neck has an outer thread that has a slightly larger diameter, the tongues can grip the threads or the tongues can be received in an axial path of the thread. Stiffness advantages are obtained because at a least a portion of the inner periphery of the ring element is disposed around the circumference of the bottle neck or the thread of the bottle neck onto which the cap is screwed.

Optionally, the ring segment or the hook segment can, along a portion of its circumference, have a radial width that provides space for signs such as symbols and/or text such as advertisement, trademark, or user name. The signs can be visible even when the carrying device is in a folded condition under the cap.

The invention is described below with examples with reference to the drawings.

Figure 1:
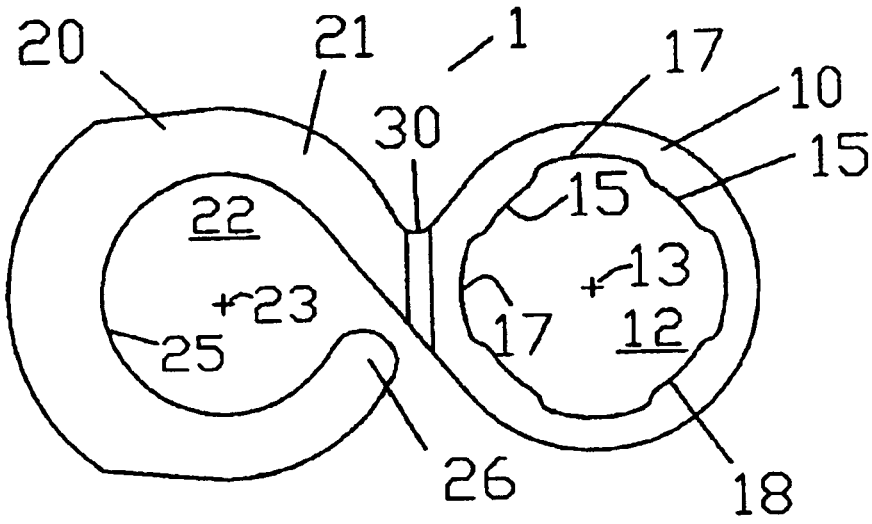
FIG. 1 shows a plane view of the carrying device of one embodiment of the present invention.
Figure 3:
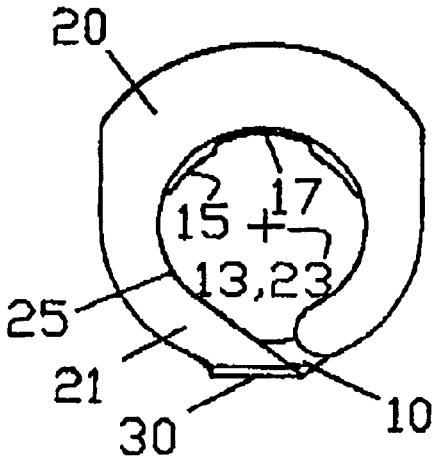
FIG. 3 shows a plane view of the carrying device according to FIG. 1 in a folded position.

FIG. 1 shows a carrying device 1 that has a substantially plane disc material or sheet material. The device 1 has a ring 10, and a hook 20 that is shown to have one open end portion 26, and another end portion 21 attached to the ring 10. The open end portion 26 extends around more than 180 degrees. The openings 12 and 22 of the ring 10 and the hook 20, respectively are substantially circular and about the same size. The carrying device has a folding line 30 that is situated between the centers 13 and 23 of the openings 12 and 22, and is perpendicular to a connection line between these centers so that the ring 10 and the hook 20, when folded about the folding line 30, have the opening centers 13 and 23 in common as shown in FIG. 3, or close to each other. The size of the openings depends on the size of a bottle neck. Common commercial drinking bottles have the outer diameters of the neck screw thread of 28 or 30 millimeters. Another common beverage bottle neck size is about 40 mm. On the other hand, baby drinking bottles have much larger diameters.

In one embodiment, the ring opening 12 has a plurality of tongues along the circumference that extend radially inwardly from an outer circular opening contour 17. The radial inner parts of the tongues 15 are disposed along an inner circular opening contour 18. The opening contours 17 and 18 have a common center 13. For the carrying device adaptable to common drinking bottles, preferably, the tongues have a depth about 1 millimeter, and a width about 10 to 12 millimeters. With the tongues, ring opening 12 can be adapted to slightly different sizes of bottle necks. For example, a commercial drinking bottle commonly has the outer diameters of the neck screw thread, or inner diameter of the bottle cap, of 28 or 30 millimeters. The ring opening 12 having a diameter of 30 millimeters of the outer circular opening contour 17 can be adapted to bottle necks having outer diameters of 28 and 30 millimeters.

Figure 2:
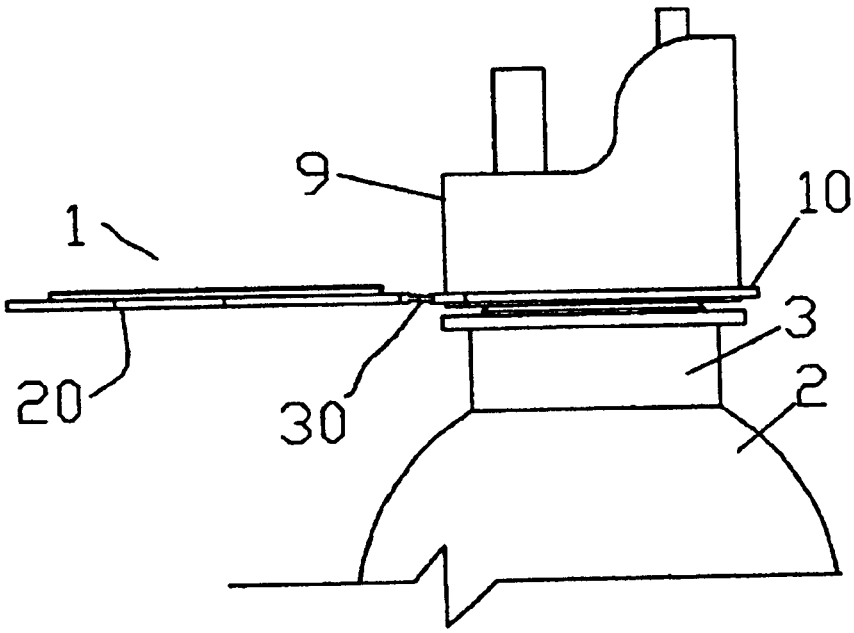
FIG. 2 shows a side view of the carrying device when applied to a bottle having a cap.

FIG. 2 shows the carrying device 1 when the ring 10 is applied about the neck 3 of the bottle 2 immediately below a cap 9 that may have an inner thread (not shown). The cap 9 is screwed on a corresponding outer thread (not shown) of the neck 3. The ring 10 can be received on the neck thread that is not shown.

FIG. 1 shows the edge 25 of the hook opening 22 that extends substantially along a circular section that has a radius that correspond to the radius of the circular section of the contour 18 of the edges of the ring tongues 15. The inner edge of the hook 20 can be received by a thread that is disposed below the cap 9 of the bottle neck 3.

Figure 4:
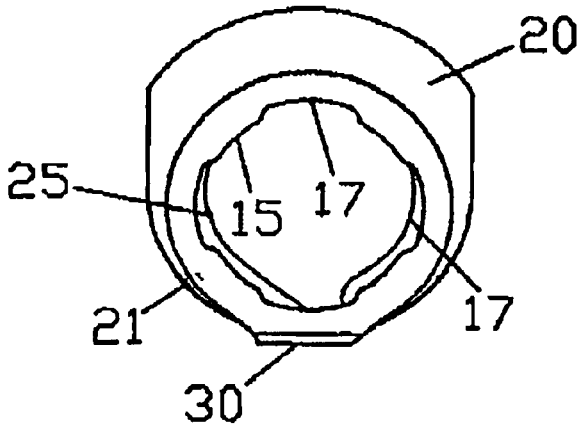
FIG. 4 shows a bottom view of the carrying device of FIG. 1 in a folded position.

When the carrying device is in the folded position, as shown in FIGS. 3 and 4, the hook 20 and the ring 10 provide a mutual stabilization that makes it easier to carry the carrying device with two fingers of a hand. The fingers, such as the index finger and the middle finger, straddle the bottle neck 3 and support the diametrically opposite components of the folded device.

Figure 5:
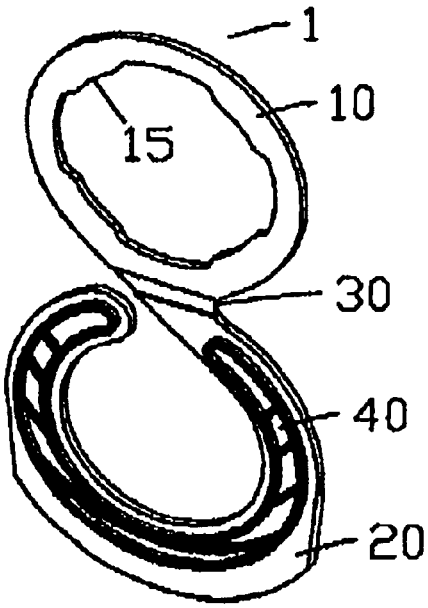
FIG. 5 shows a perspective view of the carrying device of one embodiment of the present invention with enforcement ribs.
Figure 6:
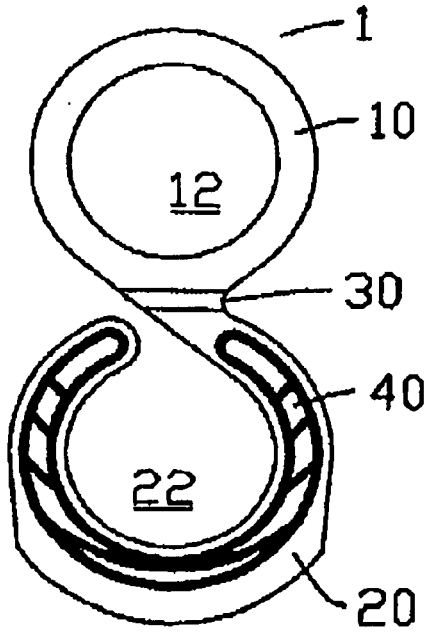
FIG. 6 shows a top view of the carrying device of one embodiment of the present invention having a circular opening in the ring segment without the tongues.

In addition, enforcement ribs 40, as shown in FIG. 5, are preferably utilized to enhance the strength, durability, and stiffness of the hook segment. Moreover, in a preferred embodiment, the width of the hook at the opposing side of the ring segment is extended as shown in FIGS. 1, 5 and 6. The extended width provides a further enforcement of the strength and stiffness of the hook segment.

As described above, the carrying device can be made of a thin planar material. The thickness of the ring segment can be in a range from about 0.5 to about 2.0 millimeters. To facilitate folding under the cap, the thickness of the ring segment is preferably from about 0.8 to about 1.5 millimeters, and the thickness of the hook segment is preferably from about 0.8 to about 3.0 millimeters inclusive of the enforcement ribs, and more preferably from about 1.0 to about 2.0 millimeters. Various types of materials can be used to make the carrying device. Suitable examples include plastics, polytetrafluroethylene (Teflon®), and metals. For drinking bottles, plastics, such as polypropylene and polyethylene, can be used. For carrying bottles containing chemicals, a chemically inert material, such as Teflon, can be used.

In a further embodiment, as shown in FIG. 6, the ring 10 of the carrying device 1 has a circular ring opening 12 without tongues.

Figure 7:
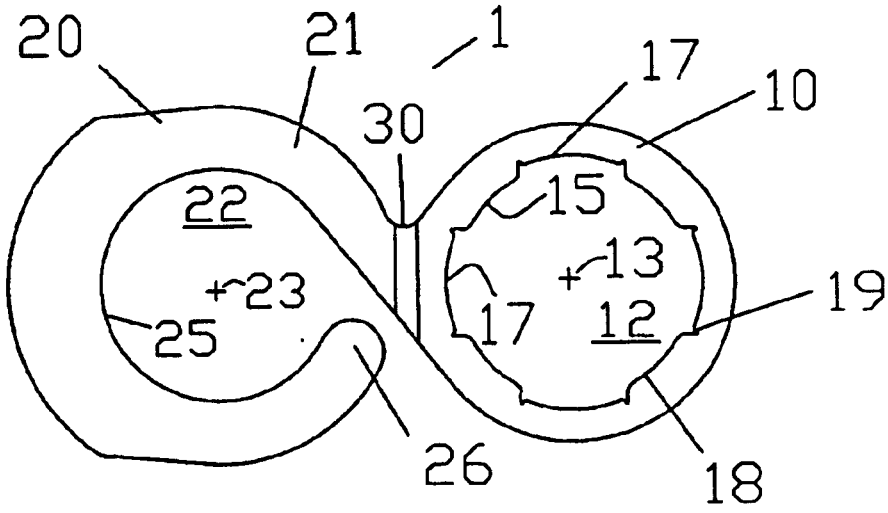
FIG. 7 shows a top view of the carrying device of one embodiment of the present invention having a plurality of incisions around the periphery of the ring opening.

In a preferred embodiment, there are a plurality of incisions 19 around the periphery of the ring opening 12, as shown in FIG. 7. With the incisions 19, the periphery of the ring opening 12 is more flexible and can be deformed to a certain degree. Such a structure enables the ring to be attached to a bottle neck after a bottle cap is already sealed on the bottle neck, by a machine or manually. Although the diameter of the ring opening 12 is smaller than the outer diameter of a bottle cap, the ring 10 can be pushed downward until it reaches below the sealing ring which is underneath and connected to the bottle cap. Once the ring is inserted below the bottle cap, it will be blocked by the bottle cap from releasing from the bottle neck. The two types of ring structures described above, i.e., with and without tongues, both can have the incisions. Preferably, there are eight incisions 19 around the periphery of the ring opening 12. The depth of the incisions can be from about 0.5 to about 1.5 millimeters, preferably from about 0.8 to about 1.2 millimeters.

The carrying device of the present invention can be sold individually as an after market product for carrying bottles. It can also be sold as a kit containing a plurality of carrying devices with different colors or decorative printings. For household use, different colors or decorations can conveniently help the family members to recognize their individual bottles.

In use, an user can adapt the ring segment 10 of the carrying device 1 to a bottle neck 3, and secure it by the bottle cap 9. Then the user can attach the hook segment 20 of the carrying device 1 to a convenient location around the body, for example, a belt, a belt loop of the pants, or the belt of a handbag, or to an equipment used for certain activities, such as a bicycle or a baby stroller. The carrying device of the present invention not only provides a convenient carrying means for a bottle, it also avoids discomfort of human hands when the hands are required to hold chilled bottles.

It is apparent that the carrying device of the present invention can be used for various water or beverage bottles. However, the carrying device can also be used for other types of bottles, such as baby drinking bottles, household cleaning bottles, sun lotion and insect repellent bottles. Furthermore, the carrying device can also be used for industrial products. It is common that after use liquid residues can remain on the exterior of a chemical bottle, which can be harmful or irritating to human hands. By using the carrying device of the present invention, the user can avoid direct contact of hands to the surface of the bottle and avoid hazardous conditions.

The carrying device of the present invention has a strong adaptability because of its thin planar structure and its foldable feature. The thin planar structure of the ring segment allows the ring segment to be secured by various types of bottle caps, such as screw-on caps, screw-on sprayer heads, and baby drinking or feeding bottle caps. The foldable feature, and its inherent flexibility, allows the carrying device and the attached bottles to be comfortably attached to various locations without unfitting angles or undesired rigidness. The foldable feature of carrying device can be used for displaying bottled product by hanging the bottle on a wall, or displaying the bottle through a window without requiring a shelf. In addition to carrying a bottle, the ring segment of the carrying device can also be used to carry other suitable subjects, for example, to carry a towel when a person does cleaning.

Furthermore, the foldable feature allows the hook segment being folded on top of the ring segment and being secured around the bottle neck by the bottle cap. For storage purpose, the folded condition avoids undesired tangling or attachment of the hook segment to other subjects.

Figure 8:
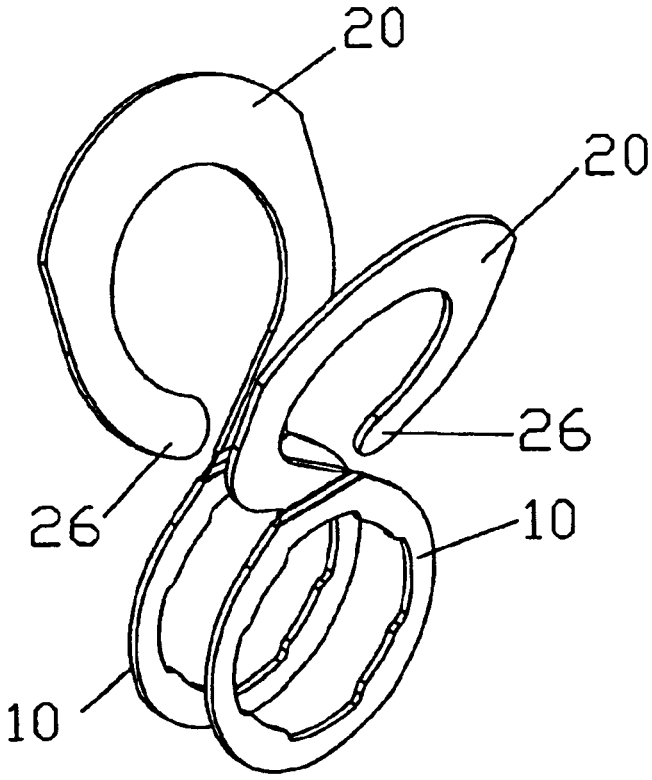
FIG. 8 illustrates one method of using the carrying device of the present invention with two carrying devices to enforce each other.

Moreover, the thin planer structural feature also permits more than one carrying devices to be used at the same time. FIG. 8 shows an example of two carrying device 1 to be used as a pair for an enhanced attachment. In such a use, both ring segments 10 can be secured under the bottle cap, the hook segment 20 can be attached to a subject with the hook opening end 26 in an opposite direction to form an interlock attachment. With such an interlock arrangement, the hooks, and the bottle, will securely attach to the subject even when the subject experiences substantial amount of movements, such as when biking in the mountains. For enforcement, a pair of carrying devices can also be used without the interlocking arrangement.

Figure 9:
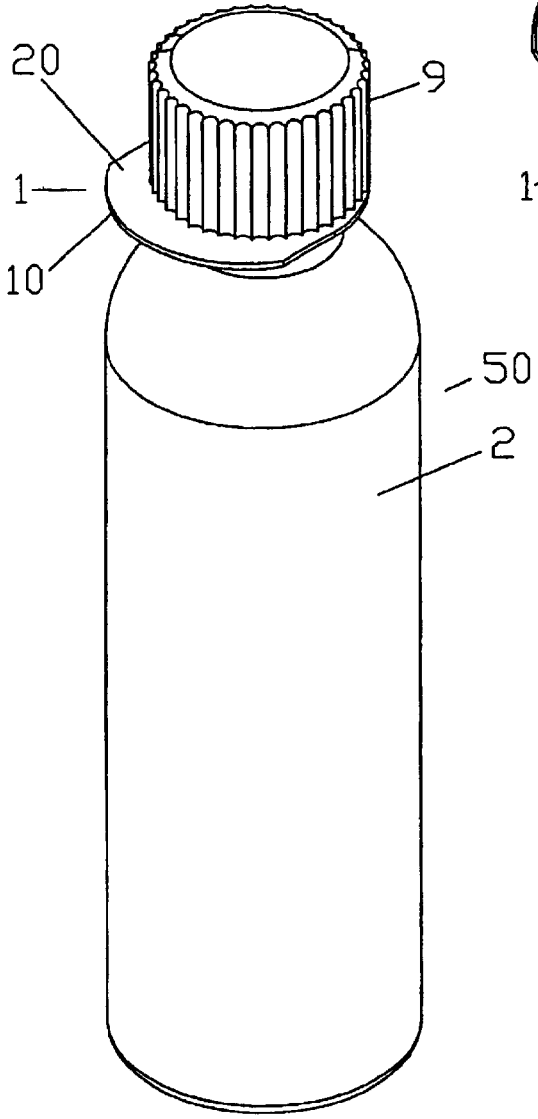
FIG. 9 shows a perspective view of an assembly of one embodiment of the present invention having a removable carrying device in a folded condition attached to the neck of a bottle.
Figure 10:
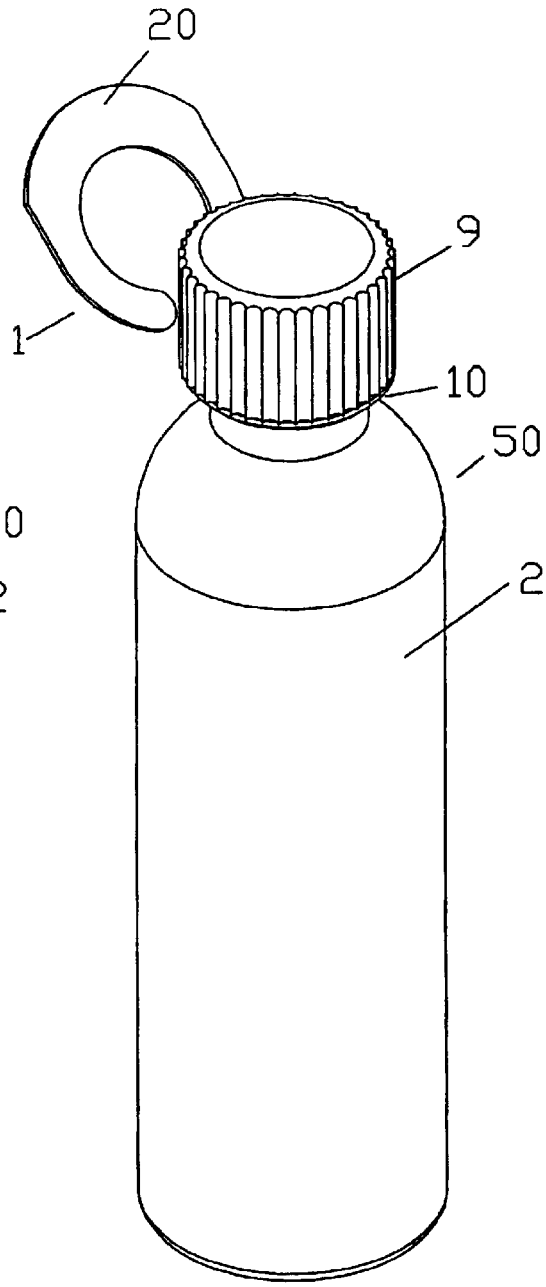
FIG. 10 shows a perspective view of the assembly shown in FIG. 8, with the hook segment of the carrying device unfolded.

In a further embodiment, the present invention provides an assembly 50 of a bottle 2 attached with a removable carrying device 1 in a folded condition as shown in FIG. 9. Because of its thin planar structure, the carrying device in a folded condition can be secured under most commonly used bottle caps. In the folded condition, the hook segment from different bottles will not tangle among them in the situation of bulk packaging. When use, the use detach the bottle cap and unfold the carrying device as shown in FIG. 10, so that the hook segment can be available for attachment. For a smaller packaging, such as a commonly seen six bottle pack, unfolded carrying devices can also be used.

For beverage companies, such as Coco Cola Company, it is convenient to provide their costumers a beverage product in a pre-packed assembly of the present invention. Such an assembly offers convenience to people who are interested in exercises, such as walking and biking; and people who have outside activities, such as outside workers; beach goers, golf or other sports players, and students on a field trip. FIGS. 9 and 10 show an assembly of a water bottle, however, the assembly can include various other types of bottles, such as household cleaning bottles, and sun lotion bottles.

While the present invention has been described in detail and pictorially shown in the accompanying drawings, these should not be construed as limitations on the scope of the present invention, but rather as an exemplification of preferred embodiments thereof. It will be apparent, however, that various modifications and changes can be made within the spirit and the scope of this invention as described in the above specification and defined in the appended claims and their legal equivalents.

What is claimed is:

1. A carrying device for attaching around a neck of a bottle below a cap surrounding the bottle neck, the carrying device has a ring segment that is received by the neck below the cap and a hook segment attached to the ring segment, characterized therein that the ring segment is shaped as a substantially planar disc, the hook segment is planar, a hook part of the hook segment extends around more than 180 degrees; the hook segment and the ring segment extend in a common plane; and there is a bendable link having an axle disposed between centers of openings of the hook segment and the ring segment and extending perpendicularly to a connection line between the centers so that the openings of the hook segment and the ring segment are directed coaxially when the carrying device is folded about the link; wherein the opening of the hook segment is substantially the same size as the opening of the ring segment and the hook segment can be folded against the ring segment and both segments can be secured around the bottle neck underneath the cap, or the hook segment can be unfolded for hooking on to an object for carrying the bottle.

2. The carrying device according to claim 1 wherein the carrying device is formed by a planar disc material.

3. The carrying device according to claim 1 wherein the ring segment has a plurality of inwardly extending tongues along a circumference of an outer circular contour of the opening, and radial inner parts of the tongues are disposed along an inner circular contour that is coaxial with the outer circular contour of the opening.

4. A carrying device for a bottle comprising:

(a) a planar ring segment having a first opening attachable to a bottle neck, and (b) a planar hook segment having a first end portion connected to the ring segment, and a second open end portion extending around more than 180 decrees forming a second opening attachable to the bottle neck; wherein the second opening has a substantially same size to the first opening; and the planar hook segment extends in a common plane with the planar ring segment and is foldable along an axis line between the hook segment and the ring segment, and the axis line is perpendicularly to a connection line between centers of the openings of the hook segment and the ring segment;

wherein the hook segment can be folded against the ring segment, and both segments can be secured around the bottle neck underneath a bottle cap, or the hook segment can be unfolded for hooking on to an object for carrying the bottle.

5. The carrying device according to claim 4 wherein a thickness of the ring segment is from about 0.5 to about 2.0 millimeters.

6. The carrying device according to claim 5 wherein the openings of the ring segment and the hook segment are circular.

7. The carrying device according to claim 6 wherein there are a plurality of incisions around a periphery of the first opening of the ring segment.

8. The carrying device according to claim 7 wherein the planar ring segment has a plurality of inwardly extending tongues along a circumference of an outer circular contour of the first opening, and radial inner parts of the tongues are disposed along an inner circular contour that is coaxial with the outer circular contour of the first opening.

9. The carrying device according to claim 8 wherein the hook segment further comprises enforcement ribs along a surface of the hook segment.

10. The carrying device according to claim 9 wherein the carrying device is made of a material selected from the group consisting of polypropylene, polyethylene, polytetrafluroethylene, other suitable plastics, and metal.

11. A bottle and carrying device assembly comprising:

(a) a bottle having a bottle neck and a cap surrounding the bottle neck, and (b) a carrying device comprising a planar ring segment having an opening attached to the bottle neck underneath the cap, and a planar hook segment having a first end portion connected to the ring segment, and a second open end portion extending around more than 180 degrees forming a second opening attachable to the bottle neck; wherein the second opening has a substantially same size to the first opening; and the planar hook segment extends in a common plane with the planar ring segment and is foldable along an axis line between the hook segment and the ring segment, and the axis line is perpendicularly to a connection line between centers of the openings of the hook segment and the ring segment; wherein the planar ring segment and hook segment can be folded against each other and the hook segment can be secured around the bottle neck underneath the cap for storage, or be unfolded for hooking on to an object for carrying the bottle.

12. The bottle and carrying device assembly according to claim 11 wherein a thickness of the ring segment is from about 0.5 to about 2.0 millimeters.

13. The bottle and carrying device assembly according to claim 12 wherein the openings of the ring segment and the hook segment are circular.

14. The bottle and carrying device assembly according to claim 13 wherein there are a plurality of incisions around a periphery of the first opening of the ring segment.

15. The carrying device according to claim 14 wherein the hook segment further comprises enforcement ribs along a surface of the hook segment.

* * * * *